US005528618A

United States Patent [19]

Schlie et al.

[11] Patent Number: 5,528,618

[45] Date of Patent: Jun. 18, 1996

[54] PHOTOLYTIC IODINE LASER SYSTEM WITH TURBO-MOLECULAR BLOWER

[75] Inventors: LaVerne A. Schlie; Robert D. Rathge, both of Albuquerque, N.M.

[73] Assignee: The United States of America as represented by the Secretary of the Air Force, Washington, D.C.

[21] Appl. No.: 157,848

[22] Filed: Nov. 19, 1993

Related U.S. Application Data

[62] Division of Ser. No. 949,616, Sep. 23, 1992, abandoned.

[51] Int. Cl.[6] ..... H01S 3/09

[52] U.S. Cl. ..... 372.00/58.00; 372/59; 415/90

[58] Field of Search ..... 415/90; 417/423.4; 372/58, 59

[56] References Cited

U.S. PATENT DOCUMENTS

| | | | |
|---|---|---|---|
| 3,189,264 | 6/1965 | Becker . | |
| 3,605,038 | 9/1971 | Byrne et al. . | |
| 3,623,836 | 11/1971 | Mandell et al. . | |
| 3,826,588 | 7/1974 | Frank | 415/90 |
| 4,068,196 | 1/1978 | Hohla et al. . | |
| 4,140,441 | 2/1979 | Patterson | 417/423.4 |
| 4,535,457 | 8/1985 | Schlie et al. | 372/58 |
| 4,706,257 | 11/1987 | Brunet et al. | 372/58 |
| 4,729,724 | 3/1988 | Henning et al. | 417/423 R |

(List continued on next page.)

FOREIGN PATENT DOCUMENTS

| | | | |
|---|---|---|---|
| 2305617 | 10/1976 | France . | |
| 191492 | 11/1982 | Japan | 415/90 |
| 195490 | 8/1987 | Japan | 415/90 |
| 2114663 | 8/1983 | United Kingdom . | |

OTHER PUBLICATIONS

"Long Operating the CW Atomic Iodine Probe Laser at 1,315 MM", Schlie et al, IEEE Journal of Quantum Electronics, vol. QE-20, No. 10, Oct. 1984, pp. 1187–1196.

"Transverse Flow CW Atomic Iodine Laser at 1,315 MM", Schlie et al., J. Appl. Phys., Jun. 1988, pp. 5664–5667.

"High-Repitition Rate Closed-Cycle Rare Gas Electrical Discharge Laser", Olson et al., Review of Scientific Instruments, vol. 47, No. 6, Jun. 1976, pp. 677–683.

"Closed-Cycle Gaseons Alkyl-Iodide ($C_3F_7I$) Supply-System", Schlie et al., Review of Scientific Instruments, Jun. 1984, pp. 482–485.

Patent Abstracts of Japan, vol. 7, No. 71 (M-202) (1216) 24 Mar. 1983 & JP, A, 57 212 395 (Hitachi) 27 Dec. 1982.

*Primary Examiner*—Edward K. look

*Assistant Examiner*—James A. Larson

*Attorney, Agent, or Firm*—Donald J. Singer; Stanton E. Collier

[57] ABSTRACT

A high power, closed cycle photolytic atomic iodine laser system having a high molecular weight gas as a laser fuel and which requires a high velocity flow of the laser fuel, the laser fuel to be in a selected low pressure range, and the laser fuel to be of very high purity. The laser system has a turbo-molecular blower for circulating the laser fuel. The turbo-molecular blower provides the high velocity flow, the selected low pressure through the laser gain cell, and a high compression ratio. The velocity is in a range of about 1 m/s to 100 m/s, the compression ratio being in a range from about 10:1 to 1000:1, the selected low pressure in a range of about 5 to 60 Torr, and the turbo-molecular blower not contaminating the laser fuel of the closed cycle fuel system by the use of ferrofluidic rotary seals. The turbo-molecular blower has a blower assembly that provides a continuous, high velocity and pressurized gas flow. The turbo-molecular blower has a housing with at least one inlet and at least one outlet for the laser fuel. The housing has a cooling source thereabout to reduce heating caused by the high molecular weight gas flowing therethrough. The blower has a motor assembly mounted externally to the housing and thereon for powering the rotor of the blower assembly; the motor assembly having a motor of at least one horsepower.

11 Claims, 5 Drawing Sheets

U.S. PATENT DOCUMENTS

| | | | |
|---|---|---|---|
| 4,734,018 | 3/1988 | Taniyama et al. | 415/175 X |
| 4,764,085 | 8/1988 | Jesinger | 415/112 |
| 4,764,086 | 8/1988 | Jesinger | 415/112 |
| 4,797,062 | 1/1989 | Deters et al. | 415/117 X |
| 4,823,349 | 8/1989 | Koop et al. | 372/34 |
| 4,904,155 | 2/1990 | Nagaoka et al. | 415/90 |
| 4,923,364 | 5/1990 | Nilsen et al. | 372/58 |
| 4,926,648 | 5/1990 | Okumura et al. . | |
| 5,008,593 | 4/1991 | Schlie et al. | 315/39 |
| 5,055,741 | 10/1991 | Schlie | 315/39 |
| 5,074,747 | 12/1991 | Ikegami et al. . | |
| 5,190,438 | 3/1993 | Taniyama et al. | 415/90 |
| 5,301,203 | 4/1994 | Schlie et al. | 372/55 |

PHOTOLYTIC IODINE LASER SYSTEM WITH TURBO-MOLECULAR BLOWER

STATEMENT OF GOVERNMENT INTEREST

The invention described herein may be manufactured and used by or for the Government for governmental purposes without the payment of any royalty thereon.

This application is a division of application Ser. No. 07/949,616, filed Sep. 23, 1992, abandoned.

BACKGROUND OF THE INVENTION

The present invention relates to a high flow, low pressure oil-free blower of heavy gases, and in particular, to an internal blower used in photolytic atomic iodine lasers. Typical gas lasers such as $CO_2$, CO, HF/DF and photolytic iodine lasers require a flow of the gas medium in order to remove gas heating or discharge/photolytic by-products. For open cycle lasers where the gas is not recirculated, there exists many types of blowers and pumps exhibiting good pumping capacity for pressures greater than a few tenths of torr as illustrated in FIG. 2. These blowers, FIGS. 2A and 2B, for example, are not suitable in closed cycle gas handling systems requiring minimal contamination because the rotating seals and bearings are oil lubricated. For high pressures (>100 torr), closed cycle laser systems, a vane-axial fan blower using ferrofluidic seals have been used with some success. Unfortunately, at pressures below 100 torr, no blowers exist having any reasonable pumping capacity to produce high flow velocities without creating gas contamination. A CW or pulsed photolytic atomic iodine laser at 1.315 microns uses a very heavy molecule $C_3F_7I$ as the starting gaseous species for promoting lasing. Previously, only passive $C_3F_7I$ flow systems have been used providing flow velocities of only 1–2 m/sec. For higher power cw and higher repetition rate pulsed photolytic iodine lasers, much higher flow velocities are required along with small pressure variations. In addition, its employment with an evaporative/condensative system for providing clean $C_3F_7I$ laser fuel creates another critical innovation. This is the resultant large gas compression ratio since the inlet gas pressure is low (fractions of a Torr to a few Torr) from the condensative/evaporative fuel system and the outlet gas pressure is much higher pressure, typically a factor of 10 to 20 and greater. To overcome these limitations, an internal blower capable of flow velocities greater than 10 m/s for the $C_3F_7I$ while operating at relatively low pressures but still constant of 5 to 60 Torr is required. Significant complications arise, however, since the $C_3F_7I$ is a very massive molecule of 293 amu (atomic mass units). Previous pumps operating at very fast rpms (~20,000) had rotors interleaved between stators which provided excellent pumping capacity for pressures of $10^{-9}$ to approximately $10^{-3}$ torr. FIG. 5 shows typical pumping curves for such turbo-molecular pumps. The loss of pumping capacity for pressures greater than a millitorr occurs because the torque power provided by the internal motor of conventional pumps is insufficient to pump the higher gas densities experienced as the pressure increases. Another deficiency of existing turbo-molecular pumps is the oil-lubricated bearings and elastomer or O-ring rotating seal. Many of these pumps overcome oil contamination problems by exhausting gas to the external environment through the rotating seal 84. Two conventional non-contaminating blowers being the piston drive and centrifugal could not simultaneously produce the flow velocity at low pressures (5 to 60 Torr) with small pressure fluctuations and negligible gas contamination from oil vapor in sustained operation with this heavy molecular gas. These problems prevented their use as an internal, closed cycle blower of gases at pressures in the 0.1 to 100 torr range while still providing contamination-free gas with high gas compression ratios.

SUMMARY OF THE INVENTION

The present invention is a turbo-molecular blower for use in a closed cycle laser system using high molecular weight gases to produce nearly constant flow velocities and large gas compression ratios.

The turbo-molecular pump of the present invention comprises, basically, a series of axial, rotating high-speed rotor disks being interleaved with stationary stator blades. The rotor shaft is mounted in the blower housing by means of a ferrofluidic rotating seal which prevents oil contamination and provides vacuum integrity. Because of the high molecular weight gases and the velocities needed of such, an external multi-horsepower motor drives the blower. External cooling is further provided to reduce heat generated inside the blower from the kinetic energy given to this heavy gas by the rotors of this turbo-molecular blower. Due to the high torque available, pressures from 0.1 to 100 torr are possible with high density gases, high flow velocities, and large gas compression ratios.

Therefore, one object of the present invention is to provide a turbo-molecular blower providing high velocity gas flow of low and high molecular weight gas vapors at low (<0.1 torr) to intermediate pressure (<100 torr).

Another object of the present invention is to provide a turbo-molecular blower capable of large compressions of circulated molecular gases.

Another object of the present invention is to provide a turbo-molecular blower that provides impurity/contaminant free flow and a flow of atomic/molecular gases over large pressure ranges (0.1 to 100 torr).

Another object of the present invention is to provide a turbo-molecular blower that provides uniformly constant gas flow of atomic/molecular gases necessary to create non-perturbative gas flow in pulsed/cw high power/energy photolytic atomic iodine laser at 1.315 microns.

Another object of the present invention is to provide a turbo-molecular blower that creates continuous and reliable gas flow of alkyl iodides in pulsed and cw iodine laser in the presence of high electromagnetic field intensities (emi).

Another object of the present invention is to provide a turbo-molecular blower that operates in conjunction with condensative/evaporative iodine ($I_2$) removal system for the alkyl iodide laser "fuel" $C_3F_7I$.

Another object of the present invention is to provide a turbo-molecular blower that provides an internal blower with a large gas compression ratio to operate in conjunction with a condensative/evaporative $C_3F_7I$ laser fuel supply system such that low input pressures can be elevated to much higher pressure values with negligible pressure fluctuations.

Another object of the present invention is to provide a turbo-molecular blower that provides operation of a laser system such that a variable velocity is selectable via changing the rotational speed of the rotors by employing variable speed a.c. or d.c. motors.

Another object of the present invention is to provide a turbo-molecular blower employing rotor and stator blades being aerodynamically shaped for higher efficiencies.

Another object of the present invention is to provide a turbo-molecular blower that provides an internal blower with an easily exchangeable external motor.

These and many other objects and advantages of the present invention will be readily apparent to one skilled in the pertinent art from the following detailed description of preferred embodiments of the invention and the related drawings.

DETAILED DESCRIPTION OF THE PREFERRED EMBODIMENT

Figure 4:
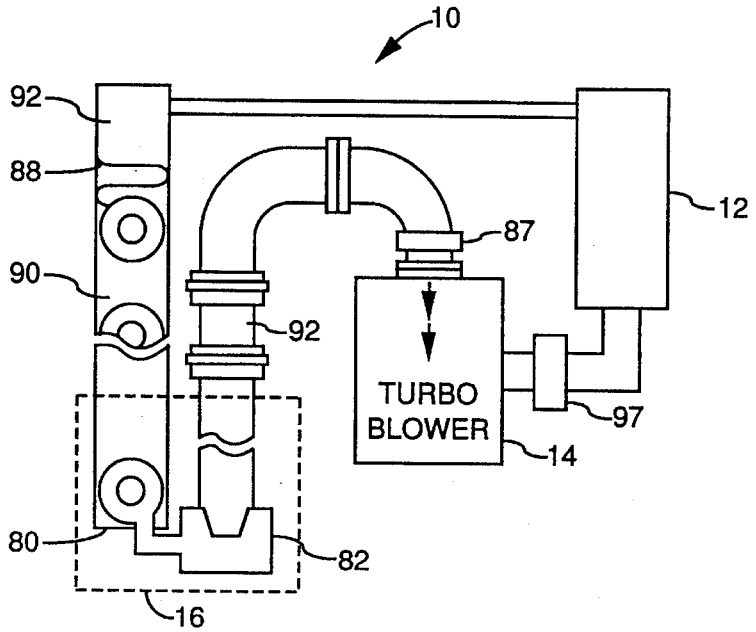
FIG. 4 illustrates an application whereby the turbo-molecular blower of this invention is coupled with a 12 laser (fuel) $C_3F_7I$ supply, condenser and evaporator sections, and an 12 removal system.
Figure 5:
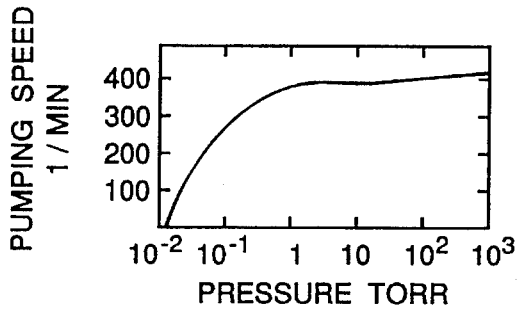
FIG. 5 PRIOR ART
FIG. 5 illustrates by graph pumping speed in relation to pressure created.
Figure 6:
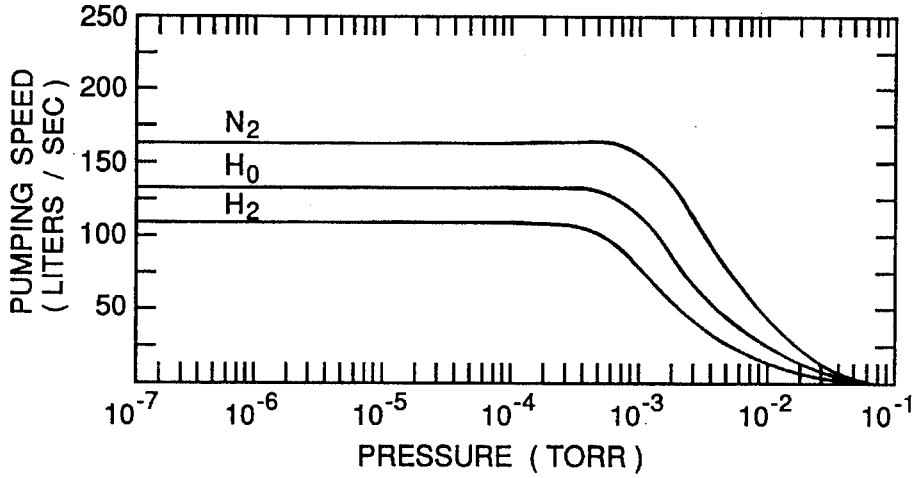
FIG. 6 PRIOR ART
FIGS. 6 illustrates by graph a pumping speed curve for conventional turbo-molecular pumps.

Referring to FIG. 4, a partial laser system 10 is shown. A laser cavity 12 is connected to a turbo-molecular blower 14 that receives a heavy molecular weight gas such as $C_3F_7I$ from a fuel/by-product removal section 16. The fuel with by-products therein leaving laser cavity 12 are input into the fuel/by-product removal section 16 for appropriate treatment therein. Fuel is output therefrom and is circulated back to the laser cavity 12, i.e., thus a closed cycle system. Although the turbo-molecular blower 14 was specifically made with the above system in mind, it can be used with other systems. Both upstream and downstream to the turbo-molecular blower 14 of FIG. 4 are optional heat exchangers 87 and 97 to heat or cool the passing gas.

The following patents are incorporated by reference U.S. Pat. No. 4,535,457; U.S. Pat. No. 5,055,741; and U.S. Pat. No. 5,008,593. The following publications are incorporated by reference: Schlie, LaVerne A., and Rathge, Robert D., "Closed-Cycle Gaseous Alkyl-Iodide ($C_3F_7I$) Supply System," *Review of Scientific Instruments.* vol. 56, p. 482, 1984; same authors as above, "Long Operating Time cw Atomic Iodine Probe Laser at 1.315 uM," *IEEE Journal of Quant. Electr.,* vol. 20, 1187, 1984; same authors as above, "Transverse Flow cw Iodine Laser at 1.315 uM," *J. of Appl. Phys.,* vol. 63, 5664. 1988.

Figure 1A:
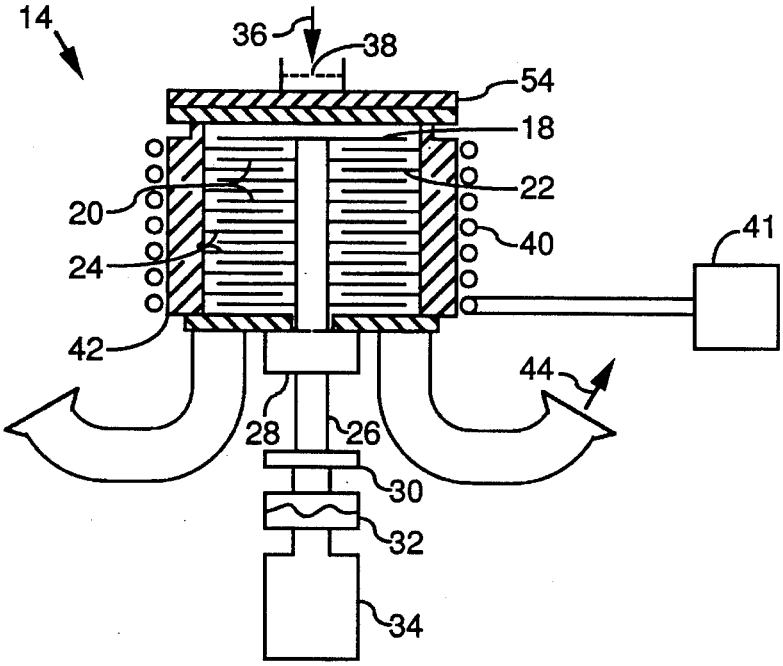
FIG. 1A illustrates by schematic the turbo-molecular blower of the present invention with direct coupling of the rotor to a high torque motor.

Referring to FIG. 1A, the turbo-molecular blower 14 is shown schematically. At gas inlet 36, a screen mesh 38 is placed to prevent any particles, like $I_2$ small crystals from entering the rotor/stator arrangement causing catastrophic damage. Therein, an axial rotor 18 having a set of rotor blades 20 are interleaved with a set of stator blades 24 of stator 22. The rotor blades 20 are attached to a rotor shaft 26. The inside of the turbo-molecular blower 14 is vacuum isolated from the external environment by means of a ferrofluidic rotating vacuum seal 28 about the shaft 26. The rotor shaft 26 is secured in axial alignment by means of an external shaft alignment bearing 30 which is essential for high rpm operation. The rotor shaft 26 is further connected by a flexible coupling 32 to a multi-horsepower motor 34 to transfer torque and minimize any vibration on the rotor shaft 26. At the gas inlet 36, a fine screen 38 is placed to prevent any particles from impinging on the rotor blades 20 or the stator blades 24. Due to the higher gas densities at typically 2000–3400 rpm rotor shaft rotations present in this blower 14, a cooling supply 41 circulates water, for example, through external water cooling coils 40 on the blower housing 42. Such wall heating occurs due to the increased kinetic energy of the gases being transported. At the bottom of the blower 14, many different output ports 44 are available, if needed.

Figure 1B:
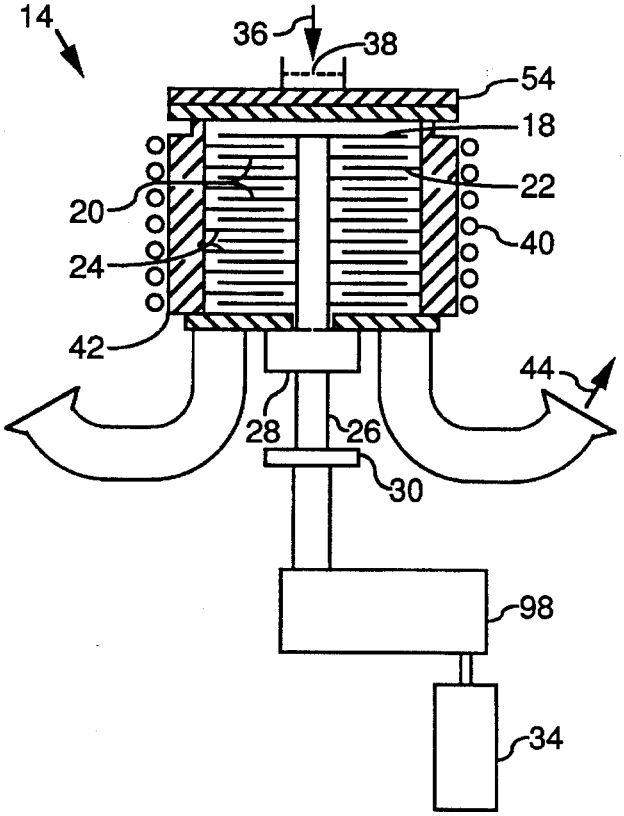
FIG. 1B illustrates the present invention with indirect motor-rotor shaft coupling using a gear assembly.
Figure 2A:
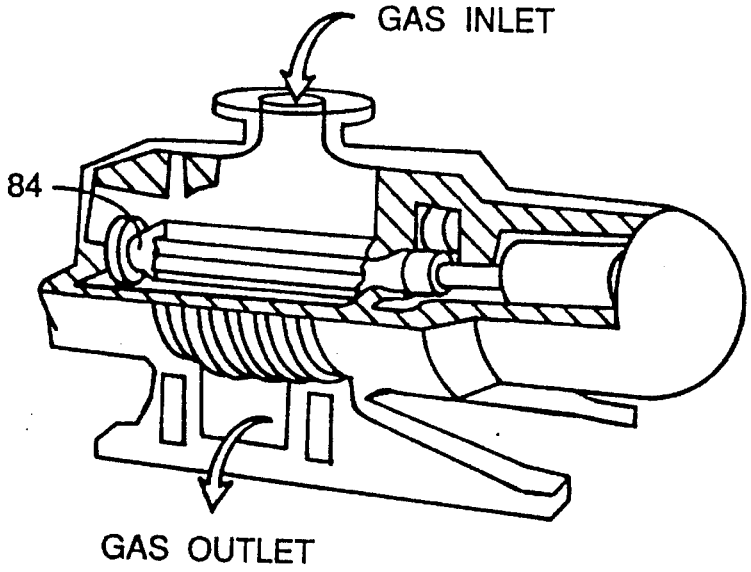
FIG. 2A PRIOR ART
FIGS. 2A and 2B illustrate two prior types of pumps.
Figure 2B:
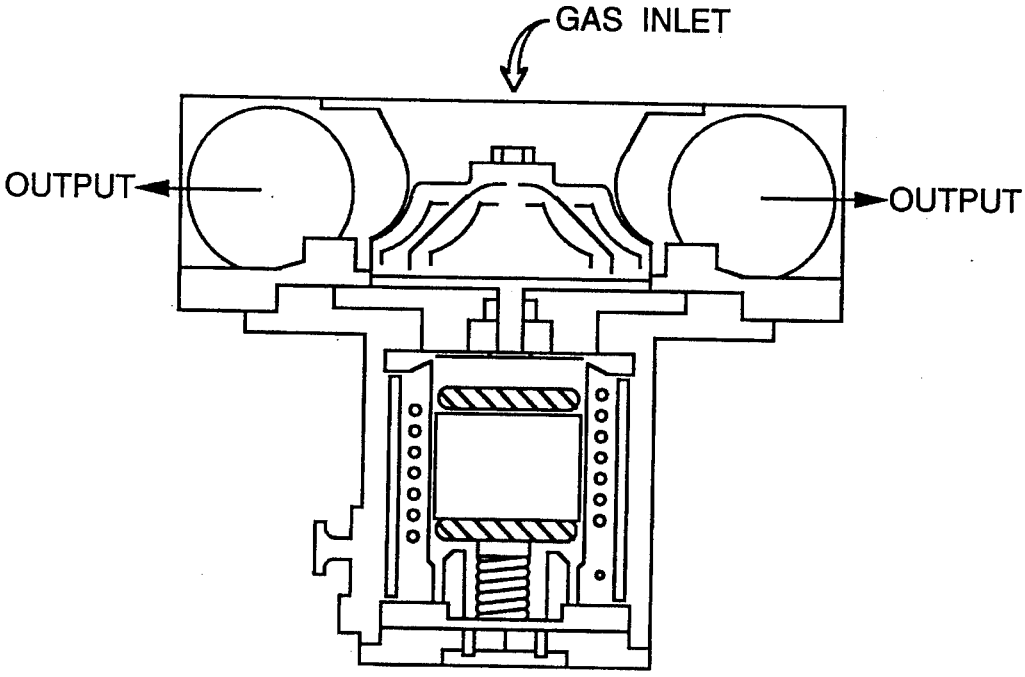
FIG. 2B PRIOR ART
Figure 3:
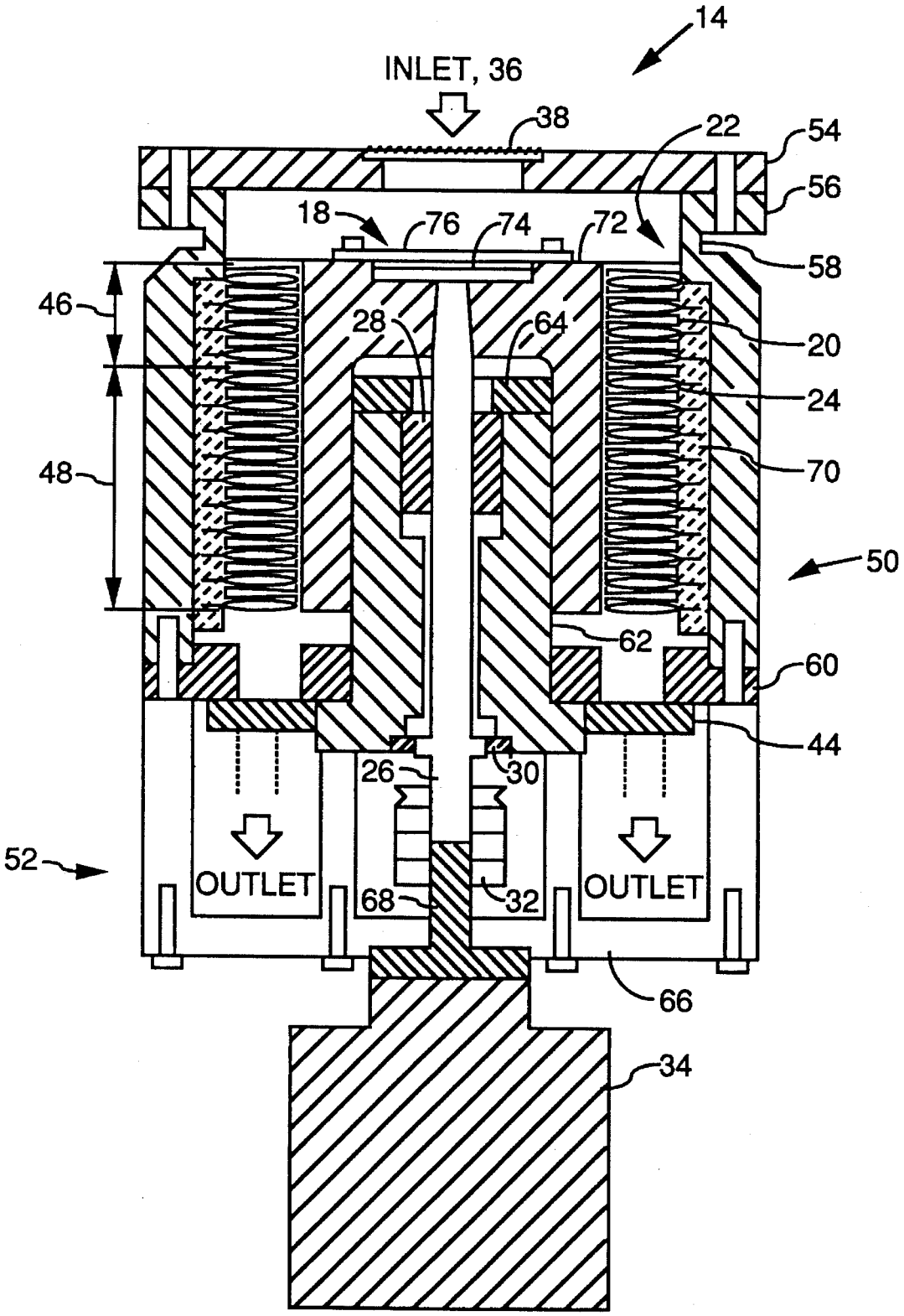
FIG. 3 is a side view cross section of the turbo-molecular blower of the present invention.

Referring to FIG. 3, a detailed cross section of the turbo-molecular blower 14 is shown. Similar items as seen in FIG. 1 are identified therein. The turbo-molecular blower 14 has a low pressure section 46 and a high pressure section 48. The pressure change from the low to the high pressure section would be gradual. The additional details as seen in FIG. 3 provide means for holding the elements noted in FIG. 1.

As seen in FIG. 3, a blower assembly 50 is connected to a motor assembly 52. The blower assembly 50 comprises a blower inlet flange 54 connected to an inlet flange 56. This is connected to a blower housing 58 having connected at the base thereof a baseplate 60 and the outlet ports 44. A rotor 18 is attached in a rotor support 62.

The motor assembly 52 comprises the electric motor 34 attached to a motor flange 66. This is connected to the baseplate 60. The electric motor 34 has its output shaft 68 connected to a flexible coupler 32. The rotor shaft 26 is also connected to the flexible coupler 32 as explained above. The rotor shaft 26 is centered by means of the shaft alignment bearing 30 and farther attached therein is the ferrofluidic rotating seal 28 which vacuum protects the interior of the blower assembly 50 from contamination. Simply, a ferrofluidic rotating seal is an assembly which consists of a central rod placed concentrically inside another fixed cylindrical housing. Between the fixed outside housing and the rotating, internal rod is a magnetic fluid or magnetic liquid. Using an external magnetic field on the magnetic fluid forces this liquid to the metal surfaces thereby assuring a good vacuum while the central rod is rotating. In addition, these magnetic fluids or ferrofluids produce negligible gas contamination. A seal cap 64 retains the seal 28 within the rotor support 62. The rotor 18 comprises the rotor shaft 26 connected to a rotor body 72 with the rotor blades 20 connected thereon. A rotor cap 74 and a cover plate 76 are placed on top of the rotor body 72.

The stator 22 comprises a spacer ring 70 which has the stator blades 24 attached thereon.

The gas of concern enters through the inlet 36 and flows into the low pressure section 46, high pressure sections 48, and out the outlet ports 44.

The manner of connecting/attaching or otherwise securing the above items in considered conventional.

The turbo-molecular blower 14 used a casing from an Airco-Corp turbo-molecular pump 1514. The Airco-Corp turbo-molecular pump Model 1514 was modified by removing the internally mounted low torque, high rpm frequency controlled motor and installing the rotor support 62 to hold the vacuum and pressure seal. This rotor support 62 contained the non-oil contaminating, vacuum or pressure Ferrofluidic (M/N sc-1000-C) rotating seal 28 and the external alignment bearing 30 which is mounted around the rotor shaft 26 to assure concentric rotor 18 rotation protecting both the stators and the ferrofluidic seal. A flexible coupling 32 was employed to connect the rotor shaft 26 to the motor 34. The motor 34 was attached to the blower housing via 10 motor support rods. Although the motor is mounted externally in the present application, an internal motor is possible but this is complicated by motor heating and the space available in the housing. Greater flexibility is achieved when the motor is mounted external to the blower housing. Finally, the rotor shaft 26 was driven by either an a.c. motor, for example, 2 h.p., rotating at, for example, a fixed frequency of rotation of 3400 rpm or a variable d.c. motor of at least one horsepower rotating at a speed which can be controlled. The diameter of the rotors and stators were 16". This size was required because of an existing housing but, clearly, any size may be appropriate depending on the driven gas and other requirements. The turbo-molecular blower 14 is capable of operating at variable rotational speed with the upper limit of approximately 20,000 rpm dictated by driving motor/gear ratio assembly and the rotating ferrofluidic seal. The rotational motion of the rotors imparts kinetic energy to the high mass gas molecules which via collisions with the fixed stators and housing walls produces significant heating of the turbo-molecular blower assembly. Because of the heat generated when driving high amu molecules, the cooling coils 40, FIG. 1, were placed about the blower housing 58. At the bottom compression side of the blower 14, FIG. 1 shows two exit ports which provide $C_3F_7I$ at flow velocities greater than 10 m/s to the iodine gain cells. Using either a dc or ac motor operating at 3,400 rpm, for example, the flow velocities were initially measured using a 1 inch Vortex flow meter, M/N YF102. Higher flow velocities can be achieved using different gear ratios and larger hp motors. Larger hp motors enable higher mass gases to be pumped than the present laser fuel.

FIG. 4 depicts the integration of this turbo-molecular blower 14 into a $C_3F_7I$ laser "fuel"/iodine ($I_2$) removal system 16 employed in both cw and pulsed photolytically excited atomic iodine lasers. $C_3F_7I$ molecule has a mass of 293 amu. At the left side of the turbo-molecular blower 14 is the condenser section 80 operating from −40° to −60° degrees C and the evaporator section 82 operating from −15° to −30° degrees C which provide "clean" $C_3F_7I$ absent of any of the excited iodine quencher 12. The condenser section 80 liquifies the gas into a liquid solution of $C_3F_7I/I_2$ from the laser gain cell 12 whereas the evaporator section 82 causes the desired gas to evaporate from the liquid state and enter the turbo-molecular blower 14. Cooling coils 88 operating at −40° degrees C cool the gas 90 after reaction in the cell 12. Copper wool is placed in the path at the locations indicated by number 92. The $C_3F_7I$ gas output from this system is connected to the input of the turbo-molecular blower 14 where its gas pressure increased generating a fast flow velocity through the iodine gain cells. Compression ratios up to $10^7$ are possible. Such a gas compression ratio between the inlet and outlet ports of the turbo-molecular blower 14 is essential and only arises from the combination of the large number of rotors/stators, high rotational speeds for the rotors, and the large torque motor needed due to the high mass $C_3F_7I$ gas at outlet pressures of, preferrably, 5 to 60 Torr. Using this system, flow velocities greater than 10 m/s for 5–60 torr $C_3F_7I$ pressures occurred when the motor rotated at 3400 rpm were generated. Flow velocities as great as 100 m/s are possible. Water cooling was required on the outside of this turbo-molecular blower 14 due to gas heating of the wall via gas molecules colliding with the walls and generated due to the higher $C_3F_7I$ flow velocities. The flow velocity was uniform and satisfied both cw and pulsed modes of laser operation. Use of this turbo-molecular blower for other gases at pressures anywhere from 0.1 to 100 torr is very practical with molecular weights from about 2 to about 1000 amu's.

Figure 7:
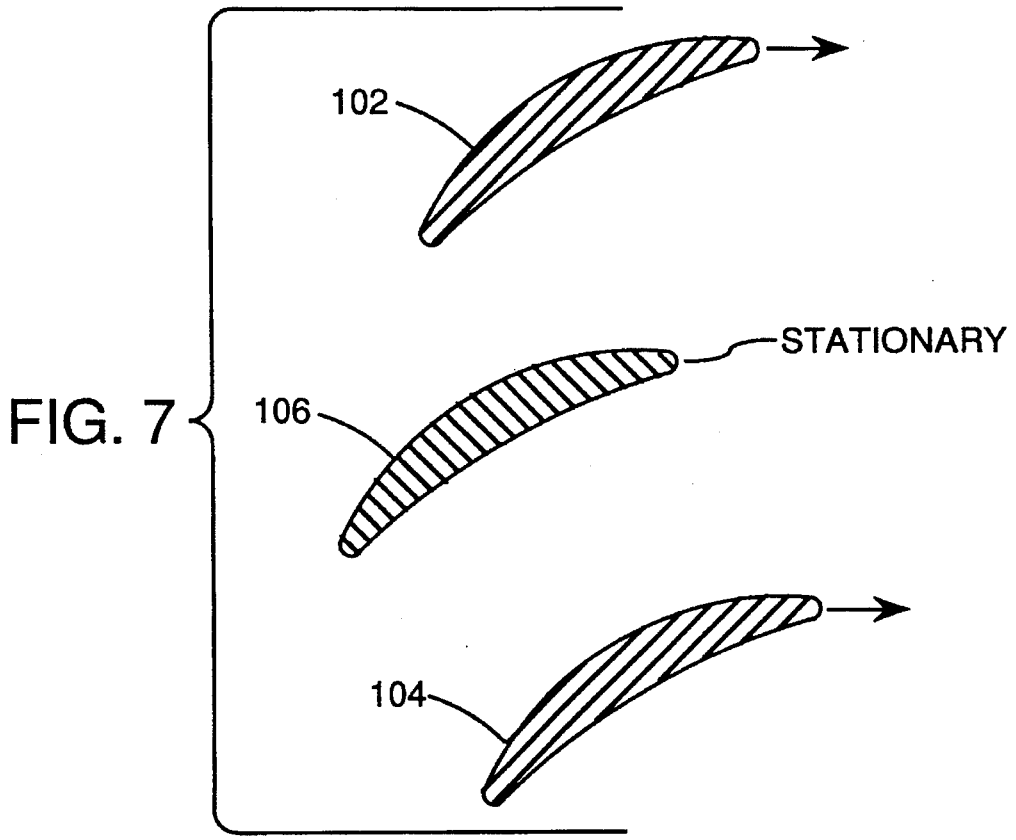
FIG. 7 illustrates the blades of the stator and the rotor being turbine-like for increased efficiency.

The above turbo-molecular blower 14 can further be improved by aerodynamic assistance using gas turbine blade configurations having curved rotors/stators with increasing radii along the direction of flow and by using a gear box to increase the rotor speed thus improving flow velocity and gas compression ratios. As seen in FIG. 7, turbine-like rotors blades 102 and 104 move past stator blade 106.

With the above turbo-molecular blower 14, the turbo-molecular blower 14 provides for the establishment of fast gas flow of high molecular weight alkyl iodide gaseous vapors at low (<0.1 torr) to intermediate pressure (<100 torr); creates large compressions of circulated molecular gases; provides impurity/contaminant free flow of alkyl iodides over large temperatures and pressure range; provides uniformly constant gas flow in pulsed/cw high power/energy photolytic atomic iodine laser at 1.315 microns; creates continuous and reliable gas flow of alkyl iodides in pulsed and cw iodine laser in the presence of high electromagnetic field intensities (emi); operates in conjunction with condensative/evaporative chemical iodine removal system for the alkyl iodide laser "fuel" $C_3F_7I$; incorporates either a pulsed or cw photolytic iodine laser utilizing longitudinal or transverse flow or any gas flow system as a series component; operates at low pressure while still producing large pumping speeds.

Clearly, many modifications and variations of the present invention are possible in light of the above teachings and it is therefore understood, that within the inventive scope of the inventive concept, the invention may be practiced otherwise than specifically claimed.

What is claimed is:

1. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^7$:1, said laser fuel being output from said means for circulating having said selected pressure in a range of about 0.1 to 100 torr, said means for circulating not contaminating said laser fuel of said closed cycle fuel system; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

2. A laser system as defined in claim 1 wherein said high velocity flow ranges from about 10 m/s to about 100 m/s.

3. A laser system as defined in claim 1 wherein said selected low pressure ranges from about 5 to 60 torr.

4. A laser system as defined in claim 1 wherein said high molecular weight gas has a molecular weight in the range from about 2 to 1000 amu's.

5. A laser system as defined in claim 4 wherein said gas is an alkyl-iodide.

6. A laser system as defined in claim 6 wherein said alkyl-iodide is $C_3F_7I$.

7. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^7$:1, said laser fuel being output from said means for circulating having said selected pressure in a range of about 0.1 to 100 torr, said means for circulating not contaminating said laser fuel of said closed cycle fuel system:

said means for circulating said laser fuel is a turbo-molecular blower, said turbo-molecular blower comprising:

a blower assembly, said blower assembly further comprising:

a housing, said housing having at least one inlet and at least one outlet for said laser fuel, said housing having cooling means thereabout to reduce heating caused by said high molecular weight gas flowing therethrough;

a stator, said stator mounted within said housing;

a rotor, said rotor mounted within said housing and turning within said stator;

a means for rotatably mounting said rotor in said housing and for preventing contamination of said laser fuel being of very high purity flowing through said blower and into said means for lasing; and a motor assembly, said motor assembly mounted externally to said housing and thereon for powering said rotor of said blower assembly, said motor assembly having a motor of at least one horsepower; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

8. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^{\&}$:1, said laser fuel being output from said means for circulating having said selected pressure in a range of about 0.1 to 100 torr, said means for circulating not contaminating said laser fuel of said closed cycle fuel system:

said means for circulating said laser fuel is a turbo-molecular blower, said turbo-molecular blower comprising:

a blower assembly, said blower assembly further comprising:

a housing, said housing having at least one inlet and at least one outlet for said laser fuel, said housing having cooling means thereabout to reduce heating caused by said high molecular weight gas flowing therethrough;

a stator, said stator mounted within said housing;

a rotor, said rotor mounted within said housing and turning within said stator;

a means for rotatably mounting said rotor in said housing and for preventing contamination of said laser fuel being of very high purity flowing through said blower and into said means for lasing; and a motor assembly, said motor assembly mounted externally to said housing and thereon for powering said rotor of said blower assembly, Said motor assembly having a motor of at least one horsepower;

said blower assembly further including means for changing the speed of said rotor, said means for changing the speed being located between said motor assembly and said blower assembly, said means for changing being a gear assembly; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

9. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^7$:1, said laser fuel being output from said means for circulating having said selected pressure in a range of about 0.1 to 100 torr, said means for circulating not contaminating said laser fuel of said closed cycle fuel system:

said means for circulating said laser fuel is a turbo-molecular blower, said turbo-molecular blower comprising:

a blower assembly, said blower assembly further comprising:

a housing, said housing having at least one inlet and at least one outlet for said laser fuel, said housing having cooling means thereabout to reduce heating caused by said high molecular weight gas flowing therethrough;

a stator, said stator mounted within said housing;

a rotor, said rotor mounted within said housing and turning within said stator, said rotor and said stator having turbine-like blades for increased aerodynamic efficiency, said blades being curved to create more forward gas motion for increasing the compression ratio;

a means for rotatably mounting said rotor in said housing and for preventing contamination of said laser fuel being of very high purity flowing through said blower and into said means for lasing; and a motor assembly, said motor assembly mounted externally to said housing and thereon for powering said rotor of said blower assembly, said motor assembly having a motor of at least one horsepower; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

10. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^7$:1, said laser fuel being output from said means for circulating having said selected pressure in a range of about 0.1 to 100 torr, said means for circulating not contaminating said laser fuel of said closed cycle fuel system:

said means for circulating said laser fuel is a turbo-molecular blower, said turbo-molecular blower comprising:

a blower assembly, said blower assembly further comprising:

a housing, said housing having at least one inlet and at least one outlet for said laser fuel, said housing having cooling means thereabout to reduce heating caused by said high molecular weight gas flowing therethrough, said housing including means to prevent any particles from entering a rotor/stator area to prevent damage thereto;

a stator, said stator mounted within said housing;

a rotor, said rotor mounted within said housing and turning within said stator;

a means for rotatably mounting said rotor in said housing and for preventing contamination of said laser fuel being of very high purity flowing through said blower and into said means for lasing; and a motor assembly, said motor assembly mounted externally to said housing and thereon for powering said rotor of said blower assembly, said motor assembly having a motor of at least one horsepower; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

11. A laser system, said laser system having a high molecular weight gas as a laser fuel, said laser system requiring a high velocity flow of said laser fuel, said laser system having a closed cycle fuel system and requiring said laser fuel to be of very high purity, said laser system comprising:

a means for lasing, said means for lasing having a laser gain cell for receiving said laser fuel, said laser gain cell requiring said laser fuel to be flowing at a high velocity and at a selected low pressure, said lasing means causing said laser fuel to lase, said lasing means outputting said laser fuel with by-products therein;

a means for circulating said laser fuel at said high velocity flow, at said selected low pressure through said means for lasing, said means for circulating providing said high flow velocity in a range of about 1 m/s to 100 m/s, said means for circulating increasing a compression ratio therethrough up to about $10^7$:1, said laser fuel being output from said means for circulating having said selected pressure in a range of about 0.1 to 100 torr, said means for circulating not contaminating said laser fuel of said closed cycle fuel system:

said means for circulating said laser fuel is a turbo-molecular blower, said turbo-molecular blower comprising:

a blower assembly, said blower assembly further comprising:

a housing, said housing having at least one inlet and at least one outlet for said laser fuel, said housing having cooling means thereabout to reduce heating caused by said high molecular weight gas flowing therethrough;

a stator, said stator mounted within said housing;

a rotor, said rotor mounted within said housing and turning within said stator;

a means for rotatably mounting said rotor in said housing and for preventing contamination of said laser fuel being of very high purity flowing through said blower and into said means for lasing; and a motor assembly, said motor assembly mounted externally to said housing and thereon for powering said rotor of said blower assembly, said motor assembly having a motor of at least one horsepower heat exchange means mounted upstream and downstream of said blower assembly to adjust the temperature of said gas entering and leaving said blower assembly; and a means for generating said laser fuel in a gaseous form and for removing said by-products from said lasing means, said means for generating condensing said gaseous laser fuel to a liquid fuel and gasifying said liquid fuel, said means for generating inputting said laser fuel into said means for circulating.

* * * * *